US010328333B2

(12) United States Patent
Jones

(10) Patent No.: US 10,328,333 B2
(45) Date of Patent: Jun. 25, 2019

(54) TABLE GAME SYSTEM

(71) Applicant: Mark Hamilton Jones and Sheryle Lynn Jones Family Trust dated Nov. 7, 2013, Gardnerville, NV (US)

(72) Inventor: Mark H. Jones, Gardnerville, NV (US)

(73) Assignee: Mark Hamilton Jones and Sheryle Lynn Jones Family Trust, Gardnerville, NV (US), dated November 7, 2013

( * ) Notice: Subject to any disclaimer, the term of this patent is extended or adjusted under 35 U.S.C. 154(b) by 185 days.

(21) Appl. No.: 15/409,661

(22) Filed: Jan. 19, 2017

(65) Prior Publication Data

US 2017/0128822 A1 May 11, 2017

Related U.S. Application Data

(63) Continuation-in-part of application No. 14/520,815, filed on Oct. 22, 2014, now Pat. No. 9,555,319.

(60) Provisional application No. 61/894,481, filed on Oct. 23, 2013.

(51) Int. Cl.

| | |
|---|---|
| ***A63F 3/00*** | (2006.01) |
| ***G07F 17/32*** | (2006.01) |
| ***A63F 1/12*** | (2006.01) |
| ***A63F 9/24*** | (2006.01) |
| ***G07F 17/34*** | (2006.01) |

(52) U.S. Cl.

CPC ..... *A63F 3/00157* (2013.01); *A63F 1/12* (2013.01); *G07F 17/322* (2013.01); *G07F 17/3288* (2013.01); *G07F 17/3293* (2013.01); *G07F 17/34* (2013.01); *A63F 2003/00164* (2013.01); *A63F 2009/2451* (2013.01); *A63F 2009/2454* (2013.01)

(58) Field of Classification Search

CPC ..... A63F 3/00157; A63F 3/00164; A63F 203/00646; A63F 2003/00826

USPC ..... 273/309, 274; 463/30, 31; 362/234, 362/249.06

See application file for complete search history.

(56) References Cited

U.S. PATENT DOCUMENTS

| | | | | |
|---|---|---|---|---|
| 6,283,856 | B1 * | 9/2001 | Mothwurf | G07F 17/32 273/138.2 |
| 8,074,991 | B2 * | 12/2011 | Chen | A63F 3/00157 273/138.1 |
| 8,177,628 | B2 * | 5/2012 | Manning | G06Q 20/3224 273/138.1 |
| 8,684,360 | B2 * | 4/2014 | van Linden | A63F 1/067 273/309 |
| 2004/0036219 | A1 * | 2/2004 | Schibetta | A63F 3/00157 273/292 |

(Continued)

*Primary Examiner* — William M Pierce

(74) *Attorney, Agent, or Firm* — John S. Artz; Dickinson Wright PLLC

(57) ABSTRACT

An improved game surface for a table game system includes a random number generator for identifying one or more numbers relevant to determining an outcome of a game of chance. The table game surface includes a game layout, including a plurality of player positions and a plurality of wagering areas corresponding to different possible outcomes. Each wagering area includes at least one illumination source associated therewith that can be switched between an on condition and an off condition. Each at least one illumination source may be configured to switch to the on condition when the wagering area with which it is associated is a winning outcome.

20 Claims, 3 Drawing Sheets

(56) References Cited

U.S. PATENT DOCUMENTS

| | | | | |
|---|---|---|---|---|
| 2005/0285341 | A1* | 12/2005 | Terminel | A63F 3/00157 273/292 |
| 2006/0217169 | A1* | 9/2006 | Manber | A63F 3/00157 463/16 |
| 2009/0170595 | A1* | 7/2009 | Walker | G07F 1/06 463/25 |
| 2009/0227312 | A1* | 9/2009 | Lima | G07F 17/32 463/13 |
| 2010/0295246 | A1* | 11/2010 | Anderson | A63F 3/00157 273/274 |
| 2011/0223983 | A1* | 9/2011 | Schwartz | G07F 17/3211 463/17 |
| 2011/0309578 | A1* | 12/2011 | Lambert | G07F 17/32 273/274 |
| 2011/0309580 | A1* | 12/2011 | Zussman | A63F 3/00157 273/292 |
| 2012/0122559 | A1* | 5/2012 | Kelly | G07F 17/322 463/25 |
| 2014/0191471 | A1* | 7/2014 | Park | A63F 1/18 273/237 |

* cited by examiner

TABLE GAME SYSTEM

CROSS-REFERENCE TO RELATED APPLICATIONS

The present application is a continuation-in-part of U.S. patent application Ser. No. 14/520,815, filed Oct. 22, 2014, which claims priority to U.S. Provisional Patent Application Ser. No. 61/894,481 entitled "Improved Table Game System", which was filed on Oct. 23, 2013, which are hereby incorporated by reference as though set forth fully herein.

TECHNICAL FIELD

The present disclosure relates generally to a table game of chance. More specifically, the present disclosure relates to a table game system and game layout for a table game of chance that provides increased user enjoyment.

BACKGROUND OF THE DISCLOSURE

Games of chance are well known activities whose outcomes are strongly influenced by randomizing devices and upon which players may wager money as they forecast outcomes. Common randomizing devices include dice, spinning tops, playing cards, roulette wheels, prize wheels, and numbered balls drawn from containers. Games of chance have been played throughout all of human history and are considered to be a popular pastime by many. Players of games of chance are attracted to new and exciting methods of game play as well as new and exciting randomizing devices and table game layouts. For this reason, the gaming industry is continuously developing new games, new randomizing devices and new table game layouts to maintain player interest and attract new players as more game play means increased revenue for the gamer operator.

Games of chance that include money wagers are typically regulated by governing authorities. These governing authorities enforce laws and regulations that are enacted to curtail certain kinds of games as well as certain kinds of randomizing devices in order to minimize irregularities and possible cheating. For example, in some jurisdictions, the use of dice or roulette wheels to resolve a game outcome, i.e., as the randomizing device, has been curtailed. Instead, randomizing devices that use playing cards have been more frequently utilized as they enjoy fewer restrictions in games of chance played for money than dice and roulette wheel randomizing devices.

Casino games typically include a playing surface, for example, a felt or cloth table betting layout, which generally includes a plurality of player positions distributed around the table. The betting layout also generally includes various wagering areas where players may place wagers on the outcome of the game. Once the outcome of the game of chance has been determined, i.e., a winning number or card selected, a dealer associated with the table typically resolves the wagers that have been placed in the various betting areas by paying out wagers made on the winning outcome and removing wagers that were made on non-winning outcomes. Before resolving the wagers, the dealer often uses a dolly marker or the like and places it on the layout in the appropriate wagering area to designate the winning outcome. This allows players to see the selected outcome and also assists the dealer in properly resolving the wagers made on the outcome. This process can be relatively cumbersome and if there are multiple winning outcomes, multiple markers are usually employed. Thus, players may not always be able to readily distinguish winning outcomes from losing outcomes.

Additionally, conventional dolly markers can sometimes be difficult to see and can be overlooked by the dealer, which can result in errors in the process of resolving any wagers made on the outcome of the game of chance. These dealer errors, also known as bleed, are known to cost casinos significant amounts of money each year.

It would thus be desirable to provide an improved layout for a table game of chance that minimizes the opportunity for dealer error and also increases player enjoyment.

SUMMARY OF THE INVENTION

It is therefore an aspect of the present disclosure to provide an improved game layout for a table game system that yields increased player enjoyment.

It is another aspect of the present disclosure to provide an improved game layout for a table game system that decreases the opportunity for dealer error and bleed.

It is still another aspect of the present disclosure to provide an improved game layout for a table game system that provides better visibility of a winning outcome for a game of chance.

In accordance with the above and the other aspects of the present disclosure, an improved table game system is provided. The table game system includes a table game surface and a random number generator for identifying one or more numbers relevant to determining an outcome of a game of chance. The table game surface includes a game layout, including a plurality of player positions disposed on the game layout and a plurality of wagering areas corresponding to different possible outcomes of the game of chance. Each wagering area includes at least one illumination source associated therewith that can be switched between an on condition and an off condition. Each at least one illumination source may be configured to switch to the on condition when the wagering area with which it is associated is a winning outcome.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE DISCLOSURE

According to an aspect, the present disclosure relates to a table game system 10. More particularly, the present disclosure relates to a table game system 10 including a card shuffling device 12 that allows a card to be randomly drawn and where the selected card can determine an outcome of a game of chance. It will be appreciated that the card shuffling device 12 may be configured to select more than one card at a single time if such an event is needed to determine the outcome of the game of chance. It will also be appreciated that instead of a card shuffling device, any other suitable random number generator may be employed in accordance with the disclosed table game system. An exemplary card shuffling device is disclosed in Applicant's U.S. Pat. No. 7,669,853, entitled "Card Shuffling Device", which is hereby incorporated by reference, as though set forth fully herein.

Figure 1:
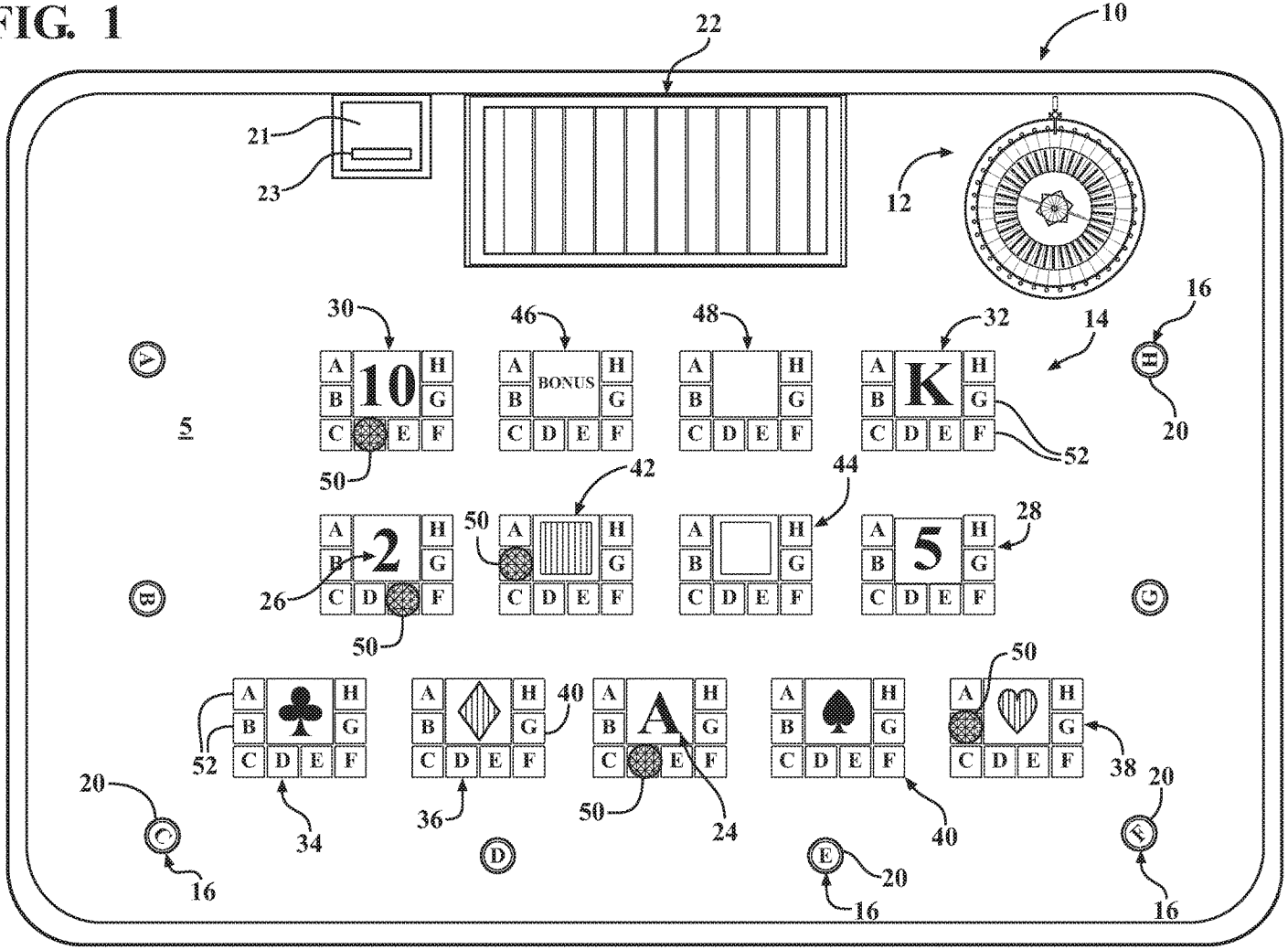
FIG. 1 is an exemplary table game layout for a game of chance in accordance with an aspect of the disclosure.
Figure 2:
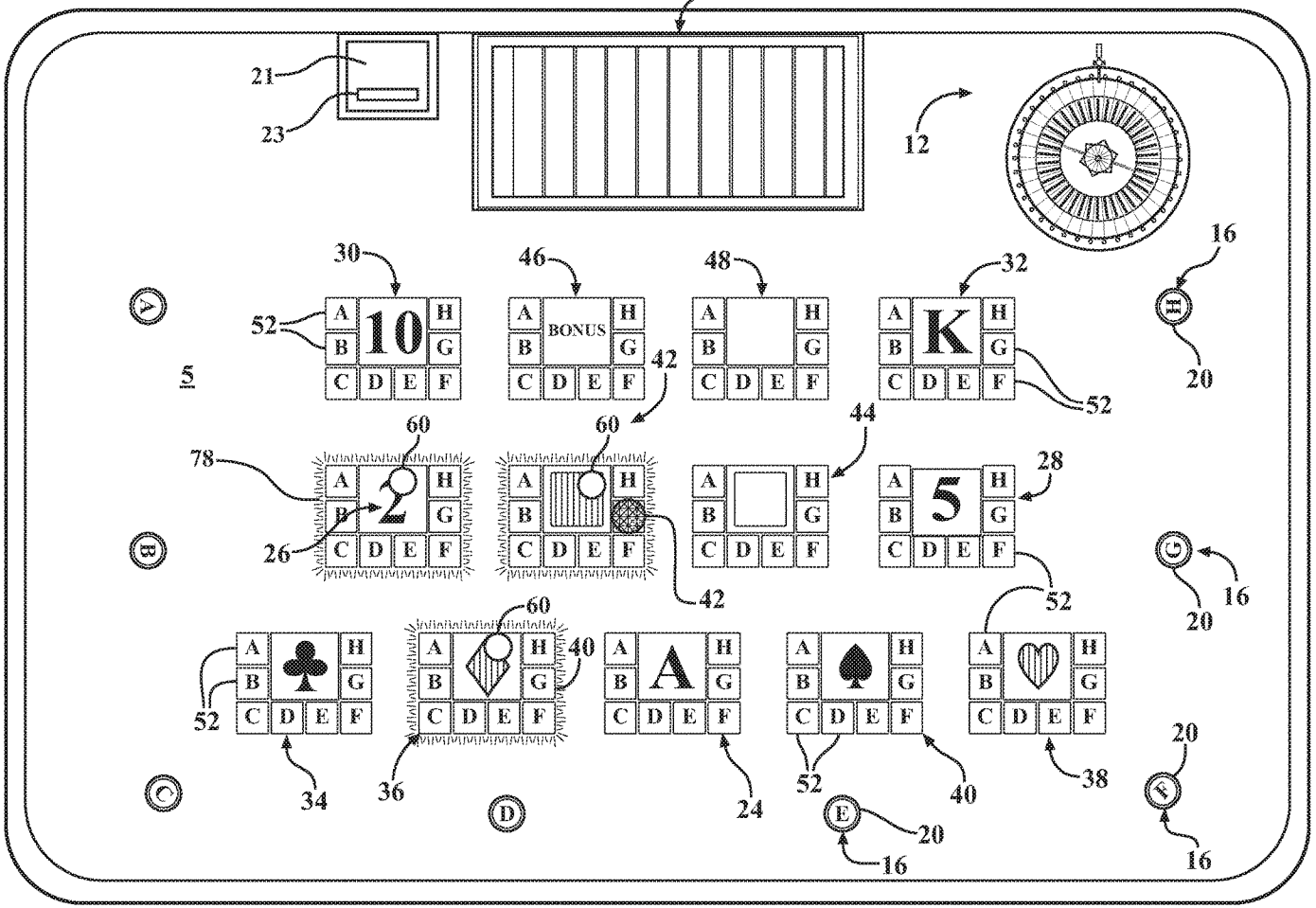
FIG. 2 is an exemplary table game layout for a game of chance with designated wagering areas illuminated in accordance with an aspect of the disclosure.

With reference to FIGS. 1 and 2, according to an aspect, the table game system 10 can include a table surface 5 with a game layout 14. According to an aspect, the game layout 14 may be disposed on an elevated table or other suitable structure. As shown, the game layout 14 can include a plurality of player positions 16 disposed on the table surface 5. The game layout 14 can also include a plurality of wagering areas, designated generally by 24-48. According to an aspect, the plurality of wagering areas 24-48 are the locations where players may make specific bets by placing a wager in the wagering area at the location corresponding to their player position. It will be appreciated that the configuration of the wagering areas 24-48 may vary depending upon the game of chance being played. It will further be appreciated that the game layout 14 may take on a variety of different configurations with different wagering areas depending upon the rules for the game of chance being played. According to another aspect, the game layout 14 may be configured for the game of roulette. It will be appreciated that the game layout 14 could be configured for other games of chance, including craps or any other casino game where the random selection of one or more numbers can decide the outcome of the game of chance.

According to an exemplary aspect, the game layout 14 may be configured for the game of Mystery Card Bonanza, which is a table game available from Inag, Inc. of Minden, Nev. The rules for the game as well as the configuration of an exemplary card shuffling device 12 that may be used with the game of Mystery Card Bonanza are described in Applicant's U.S. Pat. No. 8,505,919, which is hereby incorporated by reference as though set forth fully herein.

Briefly, according to an aspect, the game can be played with a custom fifty four (54) card deck where they cards are placed in random order in the card shuffling device 12. It will be appreciated that other suitable random number generators may be employed. In summary, there are fifty-four total cards with fifty-two of them being normal playing cards and two of them being special cards. Of those normal playing cards, they are evenly distributed among the four suits (clubs, diamonds, hearts, spades) and the two colors (black, red). According to the exemplary aspect, twenty-four of the playing cards may have an ace (A) value, fifteen of the playing cards may have a deuce (2) value, seven of the playing cards may have a five (5) value, four of the playing cards may have a ten (10) value, and two of the playing cards may have a king (K) value. Additionally, thirteen of the cards may be suited clubs; thirteen of the cards may be suited diamonds; thirteen of the cards are suited hearts; thirteen of the cards may be suited spades. Further, twenty-six of the playing cards may be colored red while twenty-six may be colored black.

According to an aspect, the game layout 14 presents a plurality of sequentially ordered player positions 16 with each player position 16 presenting an unique player indicia 20. As shown in FIGS. 1 and 2, the exemplary indicia 20 may be sequentially ordered with the letters A through F. Alternatively, the indicia 20 could be numbers, colors, or any other distinct symbols. According to an aspect, up to eight players can be stationed at the playing surface with no more than one player being stationed at each of the player positions 16. Players can leave their player position 16 at any time between rounds and new players can take the vacated spots. The table game 10 can be played with as few as one player or as many players as there are player positions. It will be appreciated that the game layout 14 may include more or less player positions as desired. It will also be appreciated that multiple players could occupy a single player position. It will further be appreciated that the player positions could be identified by the player's location around the table.

The game layout 14 additionally can include a dealer position 22, which is distinct from the player positions 16. According to an aspect, the dealer position 22 may be located on one side of the game layout 14 and adjacent the card shuffling device 12. As will be appreciated, a live dealer may be positioned at the dealer position 22 for managing the table game system 10. It should be appreciated that the table game system 10 can also be played electronically. In the electronic game, the game rules may be maintained on a computer which is configured to display a GUI of a game layout on a display and which allows one or more players to interact therewith in accordance with this disclosure. In accordance with the electronic aspect, the dealer and the dealer position 22 may not be necessary. In accordance with a further aspect, the game system 10 may be configured as an iGame within a casino, which includes a physical table, a live dealer and a physical random number generator. According to this aspect, the game system 10 could include electronic terminals at each of the player positions 16, which would allow players at the table to place a wager on the outcome electronically. Depending upon the wager selected, a signal would be sent to illuminate that player's section in the wagering area to reflect the presence of their bet.

According to an aspect, the table game layout 14 may include a plurality of value wagering areas 24, 26, 28 30, 32 where players may place a wager on the value of the winning card selected, a plurality of suit wagering areas 34, 36, 38, 40 where players can wager on the suit of the winning card selected, and a plurality of color wagering areas 42, 44 where players may place a wager on the color of the winning card selected. Additionally, the game layout 14 can present two special wagering areas 46, 48 where players can place a wager on the special cards. The players may use tokens 50 to place their wagers on the wagering areas. Any other suitable wagering areas may also be employed.

The value wagering areas 24, 26, 28, 30, 32 of the game layout 14 of the exemplary embodiment can include an aces wagering area 24, a deuces wagering area 26, a fives wagering area 28, a tens wagering area 30, and a kings wagering area 32. The suit wagering areas 34, 36, 38, 40 of the table game layout 14 can include a clubs wagering area 34, a diamonds wagering area 36, a hearts wagering area 38, and a spades wagering area 40. The color wagering areas 42, 44 may include a red wagering area 42 and a black wagering area 44. Additionally, according to an aspect, the game layout 14 can include a BONANZA wagering area 46 and an INAG wagering area 48 for allowing the players to place wagers on the BONANZA and INAG special cards respectively. In other words, there is a wagering area for each of the values, suits, and colors of the cards in the card shuffling device 12 as well as the two special cards. It will be appreciated that the cards corresponding to the wagering areas 46 and 48 could take on a variety of different indicia, such as jokers.

As shown, each wagering area 24-48 includes a plurality of player indicia 52, which replicate each of the unique player indicia 20, may be affixed within the boundaries of each of the wagering areas 24-48 to provide a place for the respective players to place their wagers. During the game, each of the players may place tokens 50 on the indicia 52 of a wagering area matching the indicia 20 of the player's position. According to an aspect, the indicia 52 allow the dealer to discern the respective wagers without reliance upon the use of color. The players may place the tokens 50 on the indicia 52 or may hand them to the dealer who will place the wagers on the indicia 52.

In accordance with an aspect, the card shuffling device 12 can randomly select at least one card to determine the outcome of the game of chance. Once the card has been identified or selected by the card shuffling device 12, the card could be removed from the shuffling device 12 and utilized to determine the outcome of the game of chance. Based on the outcome, any wagers placed in the wagering areas 24-48 can be resolved. According to an aspect, the selected card could be removed from the card shuffling device 12 by the dealer. Alternatively, the card could be removed automatically by a mechanical arm. According to a still further aspect, once the card is removed from the card shuffling device 12, the live dealer could place the card on the table for display and then resolve any wagers based on the indicia of the displayed card. Alternatively, the indicia of the card could be read by a reader device 23, such as by a camera, an RF reader, or a bar code scanner, such that it is automatically input into a computer associated with the system 10 as described herein. Associated with the reader device 23 is a home position 21 for a dolly marker 60 as described herein. A computer associated with the present game can track the location of a dolly marker 60 as it moves to and from its home position 21 about the game layout 14.

Figure 3:
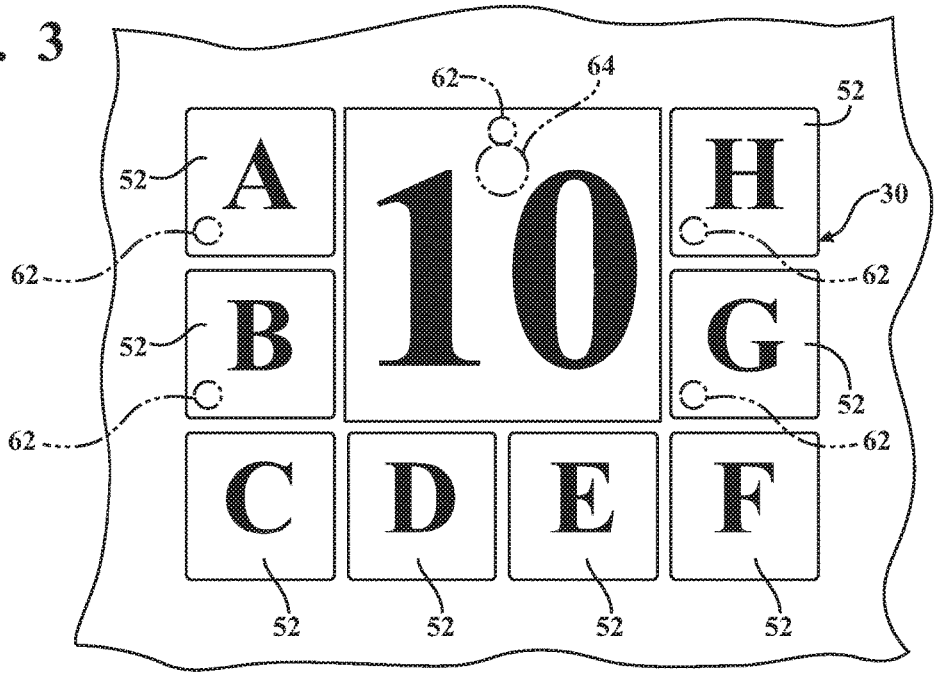
FIG. 3 is an enlarged illustration of a wagering area for the table game layout of FIG. 1.

According to an aspect, once the winning card has been selected, before resolving any wagers, the dealer can place a dolly marker 60 (FIGS. 2 and 3) in the wagering area corresponding to the value of the card selected from the card shuffling device 12, as is discussed in more detail below. According to another example, the marker 60 may be placed in a designated marker area 62 associated with each of the wagering areas corresponding to a winning outcome, as is best shown in FIG. 2. For example, the designated marker area 62 may be the center-portion of each the wagering areas. Alternatively, the designated marker area 62 may be one of the corners of each of the wagering areas. Still further, the designated marker area 62 may be disposed adjacent each of the respective wagering areas. According to a still further aspect, the game layout 14 may include a layout sensor 64 (FIG. 3) associated with each of the designated marker areas 62. For example, the layout sensor 64 could be disposed within or beneath the designated marker area 62. The layout sensor 64 could be any suitable sensor for accomplishing the aspects of the disclosure. The layout sensor 64 may be intended to communicate with the marker 60, as discussed below.

Figure 4:
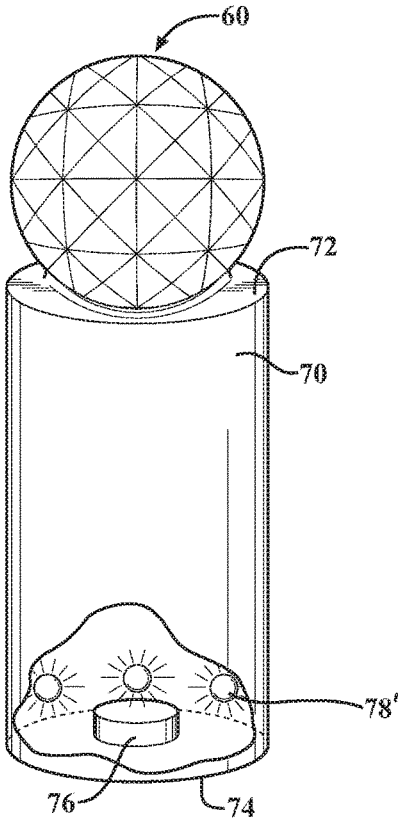
FIG. 4 is a schematic illustration of a dolly marker for use with a game of chance in accordance with an aspect of the disclosure.

According to another aspect, the marker 60 may be configured as shown in FIG. 4. Specifically, the marker 60 may have a body portion 70 with a top surface 72 and a bottom surface 74. The bottom surface 74 may be configured to be placed on the designated marker area 62 of the appropriate wagering area. According to still a further aspect, the marker 60 may include a marker sensor 76 housed therein that is intended to communicate with the layout sensor 64 associated with the designated marker area 62. According to an aspect, when the marker 60 is placed in the designated marker area 62, the marker sensor 76 can communicate with the layout sensor 64 to complete a circuit and illuminate the winning wagering area. The marker 60 may include an illumination source 78' within its body portion 70 that can illuminate when the marker sensor 76 is in communication with the layout sensor 64 in a wager area to indicate a winning outcome. It will be appreciated that the marker 60 may have any other suitable configuration. For example, instead of a dolly maker 60, one or more chips that are configured with a sensor may be employed to complete the circuit and illuminate the winning wagering area(s). Similarly, the marker sensor 76 may be any suitable sensor.

Each wagering area 24-48 can include an illumination source 78 in communication therewith. The illumination source 78 associated with a particular wagering area may be in communication with the marker sensor 76 associated with the respective wagering area. According to an aspect, when the marker sensor 76 is placed in communication with the layout sensor 64 associated with a particular wagering area, the illumination source 78 associated with that wagering area may be activated and thus illuminated to indicate a winning outcome. The illumination source 78 may normally be in an off condition. The illumination source 78 may be any suitable light source, such as an LED. According to an aspect, the illumination source 78 may consist of a strip of LEDs. However, a variety of other suitable illumination sources may be employed. The illumination source 78 may be disposed within the table surface 5 such that when activated, it may be visible to players. Each illumination source 78 may be configured to emit a variety of different colors or a variety of different effects, including pulsing or flashing. According to another aspect, the illumination source 78' may be disposed within the marker body 70 such that when the layout sensor 64 and the marker sensor 76 are in communication with one another, the illumination source 78' on the marker 60 lights up the appropriate wagering area to designate the winning outcomes. It will also be appreciated that the LEDs can be illuminated at all times, but may be configured to change colors when the marker 60 is brought into communication with the layout sensor 64 to indicate a winning outcome.

According to another aspect, the game layout 14 may be in communication with a computer such that when a winning card is selected, the dealer may input the indicia of the winning card into the computer. This input can be done by a dealer manually entering the indicia at the dealer position 22 or by the dealer inserting the card into the reader device 23 whereby the computer will read the indicia on the card. As described the reader device 23 can use a camera, an RF reader, or a bar code scanner or other reader devices to read the winning card. Pursuant to one aspect, based on the winning outcome, the computer, which is in communication with the one or more illumination sources 78 associated with the wagering areas, will cause all the wagering areas that correspond to the winning outcome to be illuminated by their illumination sources 78. For example, if a 2 of hearts was the chosen card then after the card was input into the computer by the dealer or by the card reader 23 the illumination sources 78 associated with the deuces wager 26, the hearts wager 38 and the red wager 42 would light up. In another alternative, once the computer has received the indicia of the winning card, the dealer moves the dolly marker 60 from its home position 21 to, in any order, the winning value, the winning suit, the winning color or the winning bonus wager area onto their respective designated marker area 62. Then as described, the marker sensor 76 communicates with the layout sensor 64 to complete a circuit and illuminate the winning wager area. For example, if a 2 of hearts is selected then as the dolly marker 60 is moved from the home position 21 to, in any order, the value wager area for deuces 26, the suit wager area for hearts 38 and the color wager area for red 42 an illumination source 78 or 78' associated with the winning wager area will light up. As described, the illumination can be from the illumination source 78 associated with each winning wagering area or the illumination source 78' in the dolly marker 60 as the dolly marker 60 marker sensor 76 communicates with the layout sensor 64 to complete each circuit of a winning wager area. Alternatively, as the dealer moves the dolly marker 60 from the home position 21 to one of the winning wager areas then all the winning wager areas light up based on communication of the marker sensor 76 with the first layout sensor 64 of a winning wager area. The dealer resolves the wagers in each winning wager area then moves to the next winning wager area until all wagers have been resolved. As described the wager areas can be resolved in any order, for example the dealer could put the dolly marker 60 on the winning value first, then winning suit, then winning color or right onto the winning bonus wager area. In this embodiment, the computer can keep track of which designated marker areas 62 the dolly marker 60 has been placed on to prevent the dealer from forgetting to resolve a wager or to prevent incorrect wagers from being paid out. The computer can be programmed to activate only the layout sensors 64 associated with the winning card indicia to prevent errors. In this aspect if the dolly marker 60 is placed on an incorrect designated marker area 62 the computer will not allow for the illumination source 78 or 78' to light thereby indicating that the dolly marker 60 is not placed correctly. Likewise, the computer can keep track of which wagering areas have been paid out to prevent double payouts from a single winning card. After all wagers have been resolved correctly the dolly marker 60 is returned to its home position 21 and it can then be reset. The computer can track the location of the dolly marker 60 anywhere on the game layout 14 and allows the wagers to be resolved using only one dolly marker 60 as opposed to multiple dolly markers 60. The described embodiment also allows the casino operator to track the winning cards sequentially using a log or other tracking record maintained by the computer if desired to confirm randomness of the outcomes and to resolve any dispute in real time if required. The log or record is retrievable by an operator. In an alternative aspect the computer could communicate to the maker sensor 76 the winning card indicia when the dolly marker 60 is located in the home position 21. Then the dealer moves the dolly marker 60 to the winning wagering areas in any order as described herein to resolve the wining wagers. After all winning wagers have been resolved moving the dolly marker 60 back to the home position 21 would reset the marker sensor 76 for the next winning card. In this embodiment, as described above, incorrect positioning of the dolly marker 60 on non-winning wager areas will not result in the illumination source 78/78' turning on to thereby prevent incorrect payouts. All of these effects or a combination thereof could be employed as desired.

FIG. 2 schematically illustrates an example where the selected winning card that is removed from the card shuffling device 12 is the 2 of diamonds. In this example, one or more markers 60 may be disposed in each of the wagering area 26, the wagering area 36, and the wagering area 42. The markers 60 may be placed in the respective designated marker area 62 in each of the wagering areas. When this occurs, the illumination source 78 associated with each of these areas may be switched to an on condition to light up the respective wagering area. Specifically, a marker 60 may be placed in the value wagering area 26 to reflect that any bets on the value of 2 are winning wagers. Additionally, a separate marker 60 may also be placed in the suit wagering area 36 to reflect that any bets on the suit being diamonds are winning wagers. Further, another marker 60 may be placed in the color wagering area 42 to reflect that any bets on the color red are also winning wagers. According to another aspect, a single marker 60 could be employed and moved to the appropriate area as the wagers are being resolved. Alternatively, separate markers 60 could be placed in each winning wagering area such that they are all illuminated at the same time. According to a still further aspect, illumination sources 78' on each of the markers 60 could be activated to illuminate the appropriate wagering areas.

Note that not all of the activities described above in the general description or the examples are required, that a portion of a specific activity may not be required, and that one or more further activities may be performed in addition to those described. Still further, the orders in which activities are listed are not necessarily the order in which they are performed.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Many other embodiments may be apparent to those of skill in the art upon reviewing the disclosure. Other embodiments may be used and derived from the disclosure, such that a structural substitution, logical substitution, or another change may be made without departing from the scope of the disclosure. Accordingly, the disclosure is to be regarded as illustrative rather than restrictive.

Certain features are, for clarity, described herein in the context of separate embodiments, may also be provided in combination in a single embodiment. Conversely, various features that are, for brevity, described in the context of a single embodiment, may also be provided separately or in any sub combination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The invention claimed is:

1. A table game system for a playing a game of chance, comprising:

a table surface including a dolly marker home position;

a dolly marker;

a plurality of player positions disposed about said table surface with each of said plurality of player positions having a unique player indicia associated therewith;

a plurality of wagering areas disposed on said table surface, each of said plurality of wagering areas configured to receive a wager in the form of one or more betting chips on a unique outcome for said game of chance; each of said plurality of wagering areas including a plurality of player betting areas associated therewith, with each of said plurality of player betting areas including one of said unique player indicia to represent a location for placement of said wager by said player position associated with that unique player indicia;

a random number generator associated with said table surface for identifying one or more indicia relevant to determining a winning outcome of said game of chance;

each of said plurality of wagering areas including a designated marker area that is discrete from said plurality of player betting areas and configured to receive said dolly marker identifying that wagering area as a winning outcome;

a layout sensor associated with each of said designated marker areas and configured to communicate with said dolly marker only when said dolly marker is disposed in said associated designated marker area, and wherein said communication completes a circuit;

an illumination source in at least one of said dolly marker, each of said wagering areas, or both, with each illumination source having a first mode of operation and a second mode of operation; and whereby each illumination source is configured to switch from said first mode of operation to said second mode of operation upon placement of said dolly marker on a designated marker area in one of said plurality of wagering areas and establishment of communication between said layout sensor associated with that designated marker area and said dolly marker when said wagering area with which said illumination source is associated with corresponds to a winning outcome wagering area.

2. The system of claim 1, wherein said random number generator is a card shuffling device that holds a plurality of cards with each of said plurality of cards having indicia corresponding to an outcome of said game of chance.

3. The system of claim 2, wherein said first mode of operation of said illumination source is an off condition and said second mode of operation of said illumination source is an on condition.

4. The system of claim 2 further comprising a computer, said computer receiving input of one or more indicia on a card selected from said card shuffling device representing said winning outcome.

5. The system of claim 4 wherein said input of said one or more indicia on said selected card is sent to said computer by a dealer.

6. The system of claim 4 further comprising a reader device and wherein said reader device is configured to read said one or more indicia on said card selected from said card shuffling device and to then send said one or more indicia to said computer.

7. The system of claim 6 wherein said reader device comprises one of a camera, a radio frequency reader, or a bar code reader.

8. The system of claim 4 wherein said computer, after receiving said one or more indicia, activates only said layout sensors associated with one or more winning outcome wagering areas so that when said dolly marker is placed on said designated maker associated with said one or more winning outcome wagering areas said illumination source switches from said first mode to said second mode and whereby if said dolly marker is placed on a designated marker area not associated with said one or more winning outcome wagering areas then said illumination source does not switch from said first mode to said second mode.

9. The system of claim 4 wherein said computer tracks a placement of said dolly marker on each of said designated marker areas associated with said winning outcome wagering areas and only allows for said illumination source to switch from said first mode to said second mode one time during a round of play and wherein said round is finished once all designated marker areas associated with said winning outcome wagering areas have received said dolly marker and said dolly marker is returned to said home position.

10. The system of claim 4 wherein said dolly marker resets once it is moved back to said home position after all wagers have been resolved.

11. The system of claim 4 wherein said computer communicates to a marker sensor in said dolly marker said one or more indicia of a winning outcome and wherein placement of said dolly marker on a designated marker area associated with a winning outcome wagering area switches said illumination source from said first mode to said second mode, and wherein placement of said dolly marker on a designated marker area not associated with a winning outcome wagering area does not switch said illumination source from said first mode to said second mode.

12. The system of claim 2, wherein at least one of said plurality of wagering areas is configured to receive a wager on a color of an identified card.

13. The system of claim 2, wherein at least one of said plurality of wagering areas is configured to receive a wager on a suit of an identified card.

14. The system of claim 2, wherein at least one of said plurality of wagering areas is configured to receive a wager on a number of an identified card.

15. The system of claim 4, wherein each of said illumination sources is in communication with said computer and wherein each of said illumination sources associated with a winning outcome wagering area is switched from said first mode to said second mode upon receipt by said computer of said one or more indicia of said card selected.

16. The system of claim 4 wherein said computer maintains a log of a plurality of sequential winning outcomes and wherein said log can be retrieved by an operator.

17. A table game system for a playing a game of chance, comprising:

a table surface including a reader device configured to read one or more indicia on a card;

a dolly marker;

a plurality of player positions disposed about said table surface with each of said plurality of player positions having a unique player indicia associated therewith;

a plurality of wagering areas disposed on said table surface, each of said plurality of wagering areas configured to receive a wager in the form of one or more betting chips on a unique outcome for said game of chance; each of said plurality of wagering areas including a plurality of player betting areas associated therewith, with each of said plurality of player betting areas including one of said unique player indicia to represent a location for placement of said wager by said player position associated with that unique player indicia;

a card shuffling device which can hold a plurality of cards with each of said plurality of cards having indicia for determining a winning outcome of said game of chance;

each of said plurality of wagering areas including a designated marker area that is discrete from said plurality of player betting areas and configured to receive said dolly marker identifying that wagering area as a winning outcome;

a layout sensor associated with each of said designated marker areas and configured to communicate with said dolly marker only when said dolly marker is disposed in said associated designated marker area, and wherein said communication completes a circuit;

an illumination source in at least one of said dolly marker, each of said wagering areas, or both, with each illumination source having a first mode of operation and a second mode of operation;

a computer associated with said table game system and in communication with said reader device and with each of said illumination sources, whereby said computer receives from said reader device one or more indicia of a winning outcome and then activates said illumination sources associated with a winning outcome; and whereby each illumination source is configured to switch from said first mode of operation to said second mode of operation upon placement of said dolly marker on a designated marker area in one of said plurality of wagering areas and establishment of communication between said layout sensor associated with that designated marker area and said dolly marker when said wagering area with which said illumination source is associated with corresponds to a winning outcome wagering area.

18. The system of claim 17, wherein said first mode of operation of said illumination source is an on condition and said second mode of operation of said illumination source is an off condition.

19. The system of claim 17, wherein said illumination source is disposed in said dolly marker.

20. The system of claim 17, wherein said illumination source is incorporated into said table surface.

* * * * *